United States Patent [19]

Nozawa

[11] 4,082,223

[45] Apr. 4, 1978

[54] TRIGGER TYPE SPRAYING DEVICE

[75] Inventor: Takamitsu Nozawa, Tokyo, Japan

[73] Assignee: Yoshino Kogyosho Co., Ltd., Tokyo, Japan

[21] Appl. No.: 732,096

[22] Filed: Oct. 13, 1976

[30] Foreign Application Priority Data

Dec. 6, 1975 Japan ..... 50-165534[U]
Dec. 8, 1975 Japan ..... 50-166135[U]

[51] Int. Cl.[2] ..... B05B 9/043

[52] U.S. Cl. ..... 239/333; 239/533.1; 222/321

[58] Field of Search ..... 222/320, 381, 321, 379, 222/382, 380, 474; 239/333, 533.1; 137/DIG. 4, 535

[56] References Cited

U.S. PATENT DOCUMENTS

| | | | |
|---|---|---|---|
| 1,305,868 | 6/1919 | Baun | 137/DIG. 4 |
| 3,478,935 | 11/1969 | Brooks | 222/321 |
| 3,685,739 | 8/1972 | Vanier | 239/333 |

FOREIGN PATENT DOCUMENTS

| | | | |
|---|---|---|---|
| 1,488,448 | 5/1966 | France | 239/333 |
| 490,166 | 8/1938 | United Kingdom | 239/333 |
| 648,460 | 1/1951 | United Kingdom | 239/333 |

*Primary Examiner*—John J. Love
*Attorney, Agent, or Firm*—Stevens, Davis, Miller & Mosher

[57] ABSTRACT

A fluid is sprayed from a nozzle aperture of a trigger type spraying device under pump pressure generated by the pumping action of an injection pipe member lifted and lowered vertically by an operating mechanism. Said injection pipe member includes a vertical pipe portion, corresponding to a piston, and an oblique pipe portion inclined to said vertical pipe portion. At the tip of said oblique pipe portion, there is provided a discharge valve having an elastically deformable ring member in such a manner that pulling of the trigger portion of a crank lever forces the lower half of said vertical pipe portion, corresponding to the piston, into the cylinder, thereby producing a pumping action. The fluid pressurized in the pump chamber exerts pressure, through means of a fluid passage in the injection pipe member, onto the ring member of the discharge valve in a direction whereby the ring member is flexed so as to open the valve, thereby causing the fluid to be sprayed conically from the nozzle aperture.

4 Claims, 4 Drawing Figures

TRIGGER TYPE SPRAYING DEVICE

FIELD OF THE INVENTION

The present invention relates to a device used for spraying a liquid and, more particularly, to a device in which the liquid is artificially or mechanically pressurized and sprayed out in a finely atomized form.

OBJECTS OF THE INVENTION

An object of the present invention is to provide a spraying device that is applicable to variously shaped containers, having liquids therein. Another object of the present invention is to provide a device which can readily facilitate the spray of the liquid by means of a one-handed operation of the trigger means.

SUMMARY OF THE INVENTION

According to the present invention, the spraying device is provided with an injection pipe member which is operatively connected to a pull-type trigger means, and a piston, provided in a vertical pipe portion of said injection pipe member, is lifted and lowered within a cylinder of the body portion of the device so that the liquid is sucked up into the cylinder and pressurized so as to permit pressurized liquid to be sprayed out of a nozzle aperture formed in the injection pipe member. In addition, there is provided a discharge valve of a flexible spool valve type which, when the fluid pressure in the injection pipe member is increased, is contracted in the longitudinal direction thereof so as to open the valve passage and thereby spray the liquid under pressure. In the aforementioned arrangement of the spraying device according to the present invention, even when the trigger means is pulled slowly, the liquid is not sprayed as relatively large droplets, but can be sprayed in a finely atomized form similar to the case where the trigger is pulled rapidly.

Since the body portion of the device according to the present invention is formed of a plastic material such as polypropyrene, polyethylene, or the like, the manufacturing cost thereof can be relatively low. Also, the lower end of the vertical pipe portion of said injection pipe member is provided with a slidable elastic sealing member which permits a double sealing operation to be achieved and, therefore, the sealing effect is ensured so as to prevent liquid leakage even if a gap exists between the inner surface of the cylinder and the outer surface of the lower portion of said vertical pipe portion. Furthermore, according to the present invention, the construction is rendered relatively simple and fewer number of parts are used and, therefore, the assembling of the same is simplified.

The trigger means is formed in an arcuate shape so as to facilitate the pulling action by finger manipulation. The trigger means is formed on one side of a lever which is curved in an L-shape, the base portion of said lever being pivotably attached to the tip of a bracket protruding out from the retaining cylinder. As compared with conventional trigger type sprayers wherein a discharge valve is directly protracted and retracted by the operation of a lever, or wherein a piston is reciprocated in a horizontally disposed pressurizing chamber, the spraying device according to the present invention can be operated in a light and simple manner, minimizes leakage, and, thus, provides a higher degree of efficiency. Furthermore, according to the present invention, the injection pipe member comprises of a vertical pipe portion and an oblique pipe portion, and a piston is provided in said vertical pipe portion so as to facilitate the suction of the liquid in pressurizing the same and to permit a uniform quantity of liquid to undergo suction. In addition, in the aforementioned arrangement of the device according to the present invention, even when the liquid has accidentally leaked, the leaked liquid is returned to the container without staining the outer periphery of the container or the peripheral surface of the container cap. The cranked lever comprises a yoke and the trigger means portion, the yoke end is pivotably attached to the bracket and said injection pipe member is disposed in the internal space formed in said yoke portion so that the pulling of the trigger means causes said injection pipe member to be lowered along said vertical pipe portion and the piston to be inserted into the vertically disposed cylinder despite the arcuate movement of the trigger means, thus permitting the construction of the suction valve to be simplified and leakage to be effectively prevented. Still further, the discharge valve is movably fitted in a cavity formed at the tip of the oblique pipe portion of said injection pipe member so that, when the fluid pressure in the oblique pipe portion is increased, the ring member is flexed so as to contract the effective length of the discharge valve and to produce a gap between the valve opening and the valve body portion for permitting the liquid to be sprayed until the internal pressure of the cavity becomes equal to the fluid pressure in the oblique pipe portion. Said discharge valve has integrally coupled thereto a valve body having at the center thereof an elastically deformable ring member, a base plate at one side of said ring member, having formed therein fluid slots, and a guide projection at the other side of said ring member.

The spraying device according to the present invention can be used to spray cosmetics, insecticides, furniture or floor polishing agents, window cleaner, gardening chemicals, clothwetting water and other similar liquids.

BRIEF DESCRIPTION OF THE DRAWINGS

Hereafter, these and other objects and advantages of the present invention can be readily understood from the following detailed description of the invention taken with reference to the accompanying drawings in which.

DETAILED DESCRIPTION OF THE PREFERRED EMBODIMENT

Figure 1:
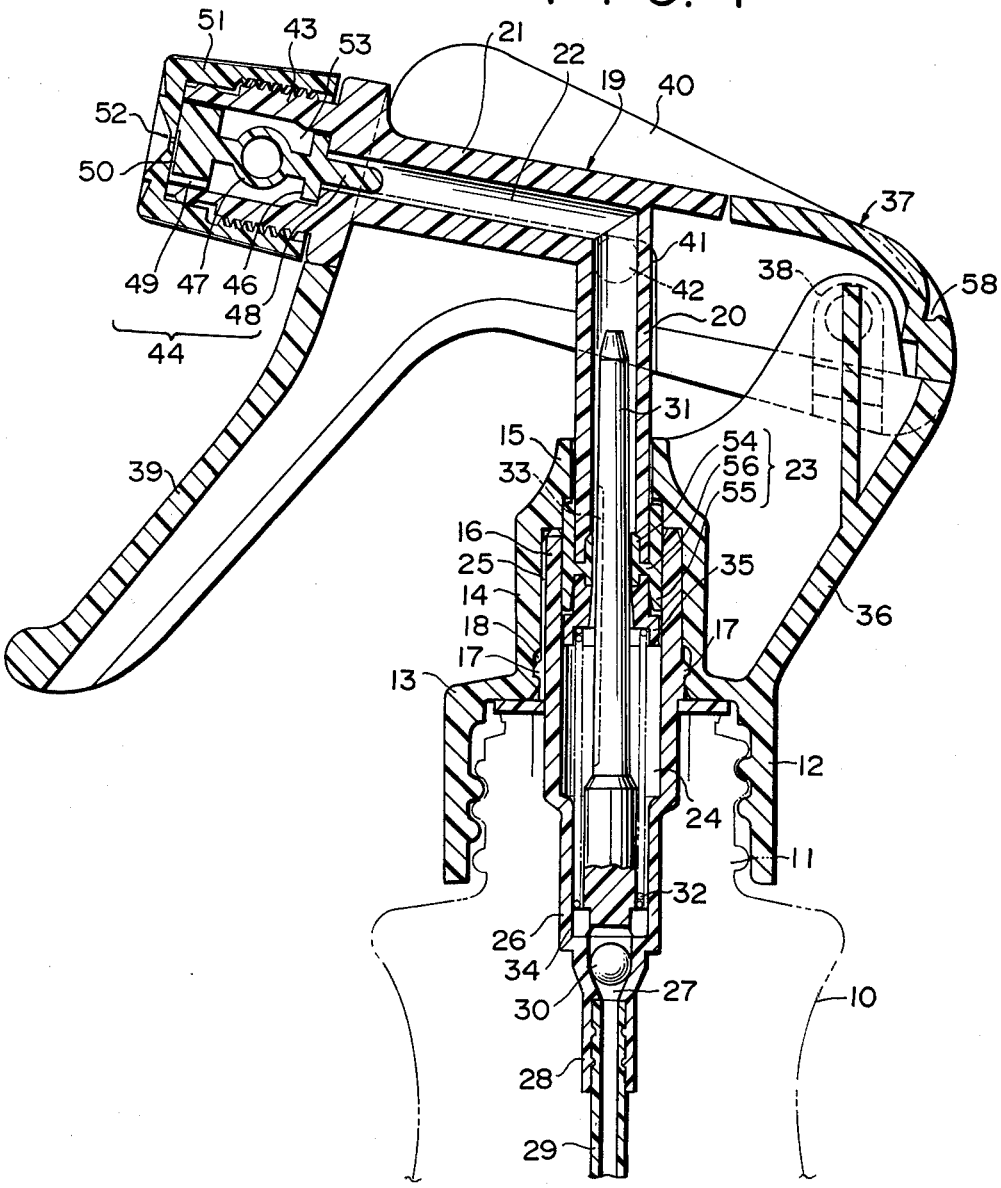
FIG. 1 is a vertical sectional view of the trigger type spraying device of the present invention.

Referring now to the drawings, the reference numeral 10 indicates a body portion of a bottle or container and is formed with a thread at the neck portion 11 thereof with which a complementary cap portion 12 is engaged. Said body portion 10 is formed of a glass, ceramic material or a flexible resilient plastic material such as polyvinyl chroide, polyethylene or polypropylene. At the upper end of said cap portion 12, a flange 13 is formed inwardly thereof and, above said flange 13, stepped cylinders 14 and 15 are integrally formed. A cylinder member 16 disposed within said cylinder 14, is provided with an annular projection 17 about the outer periphery thereof, said projection 17 being disposed within an annular concave groove 18 formed in the inner wall of said cylinder 14 so as to mount said cylinder member 16 securely within said cylinder while limiting vertical movement of said cylinder member 16. A vertical pipe portion 20 of an injection pipe member 19 is loosely disposed within and passes through, said cylinder 15, said vertical pipe portion 20 constituting a piston means together with a sealing means 23 attached to the lower end thereof. As will be described later, said injection pipe member 19 comprises said vertical pipe portion 20 and an oblique pipe portion 21 integrally formed with said vertical pipe portion 20 so as to be inclined with respect thereto, and member 19 has a fluid passage defined therein which is common to said vertical pipe and oblique pipe portions. If said sealing means 23 is lowered into a pump chamber 24 together with said vertical pipe portion 20, air is introduced into the assembly from the ambient atmosphere by means of a small gap formed between the internal surface of said cylinder 15 and the vertical pipe portion 20, and a concave groove 25 formed longitudinally along the outer surface of said cylinder member 16 so that the internal pressure of said container 10 does not become negative during the pumping action. The lower portion of said cylinder member 16 has the diameter thereof reduced in a stepped manner so as to form a stem supporting cylinder 26, and below cylinder 26, the diameter of member 16 is reduced further in a tapered manner so as to form a valve seat 27. Furthermore, below said valve seat 27, there is provided a neck portion 28 into which a cylindrical dispensing tube 29 is inserted.

A ball valve 30, constituting a suction valve, is inserted into said valve seat 27, and a stem 31 and a helical spring 32 are inserted in said pump chamber 24. The stem 31 comprises an upper portion with a reduced diameter and a lower portion with a non-reduced diameter, the tip of said reduced upper portion being disposed well within said vertical pipe portion 20. The reduced upper portion of stem 31 passes through the sealing means 23 and is formed with a longitudinal groove 33 within the vicinity of said sealing means 23 so that pressurized liquid from the pump chamber 24 is able to be fed into the fluid channel 22 from the vertical pipe portion 20. The root portion of the non-reduced portion of said stem 31 is provided with a cutout groove 34 for communicating the liquid from the suction valve to the pump chamber 24. The helical spring 32 is interposed between the shoulder portion at the lower end of said stem 31 and an upper bearing seat 35 in said pump chamber 24 so as to always bias said vertical pipe portion 20 upwardly. Therefore, when the helical spring 32 is compressed downwardly by the lowering of the injection pipe member 19, the capacity of the pump chamber 24 is reduced so as to close the ball valve 30, thereby pressurizing the liquid. The pressurized liquid is fed into the fluid passage in the injection pipe member through the longitudinal groove 33 provided in the stem 31. To the contrary, when the downward depression of the injection pipe member 19 is terminated, the vertical pipe portion 20, serving as a piston, is lifted upwardly together with the bearing seat 35 and the sealing means 23, by the action of the helical spring 32 so as to expand the capacity of the pump chamber 24 and depressurize the same, thereby permitting the ball valve 30 to be opened and the liquid to be sucked up into the pump chamber 24 whereby the same is then ready to be dispensed as a result of a subsequant downward depression of the member 19.

A crank lever 37 comprises an arcuate trigger portion 39 and a yoke portion 40 which is integrally formed with said trigger portion 39 at an angle of between 110° to 120° with respect to the latter. The cap portion 12 is provided with a bracket 36 which extends obliquely toward the rear side thereof. In the vicinity of the tip of said bracket 36, there is provided a hole for pivotably mounting a pin 38 constituting a fulcrum for the crank lever 37. Said yoke portion 40 of the crank lever 37 is provided with an internal guide groove 41 so that a pin 42, provided externally of said injection pipe member 19 at the bent portion thereof, is engaged in said guide groove 41. The crank lever 37 is normally maintained stationary at the raised position thereof as shown in FIG. 1 due to the elasticity of the helical spring 32 inserted in the pump chamber 24.

As described previously, the injection pipe member 19 comprises of the vertical pipe portion 20 and the oblique pipe portion 21, integrally coupled thereto and inclined at an angle of about 100° to said vertical pipe portion 20 and the pin 42 is disposed exteriorly of the bent portion of said injection pipe member 19 constituting the joint portion between said oblique pipe 21 and said vertical pipe portion 20. Said pin 42 is engaged in said guide groove 41, formed internally of said yoke portion 40, in such a manner that said pin 42 functions so as to permit the vertical pipe portion 20 of the injection pipe member to be driven in the vertical direction in accordance with the movement of the crank lever 37.

Figure 4:
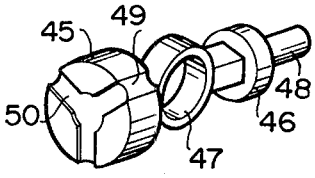
FIG. 4 is a perspective view of the discharge valve of the spray device.

In said oblique pipe 21 and vertical pipe 20 portions, a common fluid passage 22 is provided, and a nozzle cylinder 43 is provided at the tip of said oblique pipe portion 21 with a discharge valve 44, constituting a flexible spool valve being contained therein. As shown in the enlarged view of FIG. 4, said discharge valve 44 is provided with a ring member 47 between a base plate 45 and a valve body 46 thereof. Said discharge valve is formed of polyethylene or synthetic rubber, so that if pressure is exerted thereon in the axial direction thereof, the ring member 47 is flexed so as to permit the distance between the end faces of the base plate 45 and the valve body 46 to be changed. In addition, rearwardly of the valve body 46, there is provided a guide projection 48 to be inserted into the valve hole constituting a discharge opening of the fluid passage 22. A plurality of axially extending slots 49 are provided within the periphery of said base plate 45, and upon the front end face of the base plate 45, there is provided a plurality of radially extending slots 50 in communication with said slots 49 so as to lead to the center portion of a nozzle aperture 52 formed within the end face of a cap 51 threaded onto the outer periphery of the nozzle cylinder 43. Said discharge valve 44 functions, when the internal pressure of the fluid passage 22 in the injection pipe member is increased, to cause the ring member 47 to contract so as to retract the valve body 46 away from passage 22, thereby introducing the pressurized liquid into a cavity 53. The fluid passes through slots 49 and 50 and is discharged conically from the nozzle aperture 52, until the pressure in the cavity 53 of the discharge valve becomes equal to said internal pressure of the fluid passage 22.

In the meantime, the double sealing means 23, provided at the lower end of said vertical pipe portion 20, comprises an inner cylindrical portion 54 and an outer cylindrical portion 55, and an annular member 56 coupling said inner and outer cylindrical portions together, the lower end of said vertical pipe portion being disposed in the upper annular gap defined between said two cylindrical portions and said bearing seat 35 being disposed in the lower annular gap defined between said two cylindrical portions. Said double sealing means 23 is formed of a soft synthetic rubber material such as neoprene and butadiene rubber. Said double sealing means is a member constituting the piston at the lower end of said vertical pipe portion 20 together therewith and the elasticity thereof permits a smooth reciprocating movement of the piston in the vertical direction along the internal wall surface of the pump chamber 24, while maintaining a high degree of water-tightness. In other words, during the vertical reciprocation of the piston, said double sealing means 23 prevents the liquid from leaking from the cylinder member 16 and, in addition, cuts off the air communicating groove as a result of the outer cylindrical portion 55 being in close contact with the inner shoulder portion of the cylinder 15 when the vertical pipe member has been lifted to the upper limit thereof as shown in FIG. 1. Alternatively, said sealing means may be in the shape of an O-ring instead of the aforementioned double-walled cylinder having inner and outer cylindrical portions.

Figure 3:
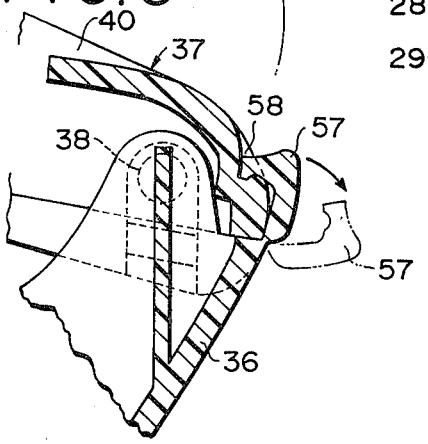
FIG. 3 is an enlarged, partial cross-sectional view of the apparatus of FIG. 1 showing, in detail, the root portion of the crank lever mechanism having operatively associated therewith a lever locking piece which is adapted to be separated from the lever mechanism prior to use of the spray device.

Furthermore, in assembling the body portion of the device, a hook member 57 may be integrally formed with the bracket 36 at the tip thereof for engaging with a latch portion 58 which may be formed on the rear end of the yoke 40 so as to prevent the crank lever 37 from being accidentally lowered and thereby inadvertently spray the liquid during the course of storage or transportation thereof. Before use, the operator of the device can separate said hook member 57 from the body by bending the same several times as to the position shown by the chain line in FIG. 3.

According to the arrangement as shown in FIG. 1, the operator holds the device, having mounted thereto the liquid container 10, in the following manner: the neck portion of the container is gripped by the middle, third, and small fingers, and the palm, so as to be wrapped about said neck portion, and the thumb is may also be added thereto and, then, the forefinger is engaged on the arcuately curved trigger means 39. In this manner, the operator can readily and safely hold and operate even a relatively heavy container by means of one hand.

In operation, if the trigger means 39 of the crank lever 37 is pulled two or three times, the vertical pipe portion 20 is reciprocated vertically in the pump chamber 24 so as to produce a negative pressure therein to suck up the liquid into the pump chamber from the container 10.

Thus, if the trigger means 39 is pulled under the condition in which the pump chamber 24 is filled with the liquid, the lower half of the vertical pipe portion 20 corresponding to the piston is vertically lowered in the cylinder member 16 as a result of the cooperative action of the guide groove 41 of the yoke 40 and the pin 42 of the injection pipe member. At this time, because the ball valve 30 and the discharge valve 44 are in the closed states thereof, respectively, the internal pressure of the pump chamber 24 is increased. Subsequently, the pressurized liquid is forced into the fluid passage 22 formed in the injection pipe member through means of the longitudinal groove 33 formed in the stem 31. Therefore, when the pressure in the fluid passage 22 is low, the valve body 46 of the discharge valve 44 closes the exit portion of said fluid passage by means of the action of the ring member 47. However, when the pressurized liquid is fed into passage 22 by the actuation of the pump so as to flex the ring member 47, the valve body 46 is withdrawn from said exit portion of the fluid passage so as to permit the pressurized liquid to enter the cavity 53 from the opened valve hole, thereby permitting the pressurized liquid to be sprayed out from the nozzle aperture 52 after passing through the slots 49 and 50. This spraying action is continued after the pulling of the trigger means 39 until the state as shown in FIG. 2 is attained, namely, the termination of the rotary movement of the crank lever 37.

Figure 2:
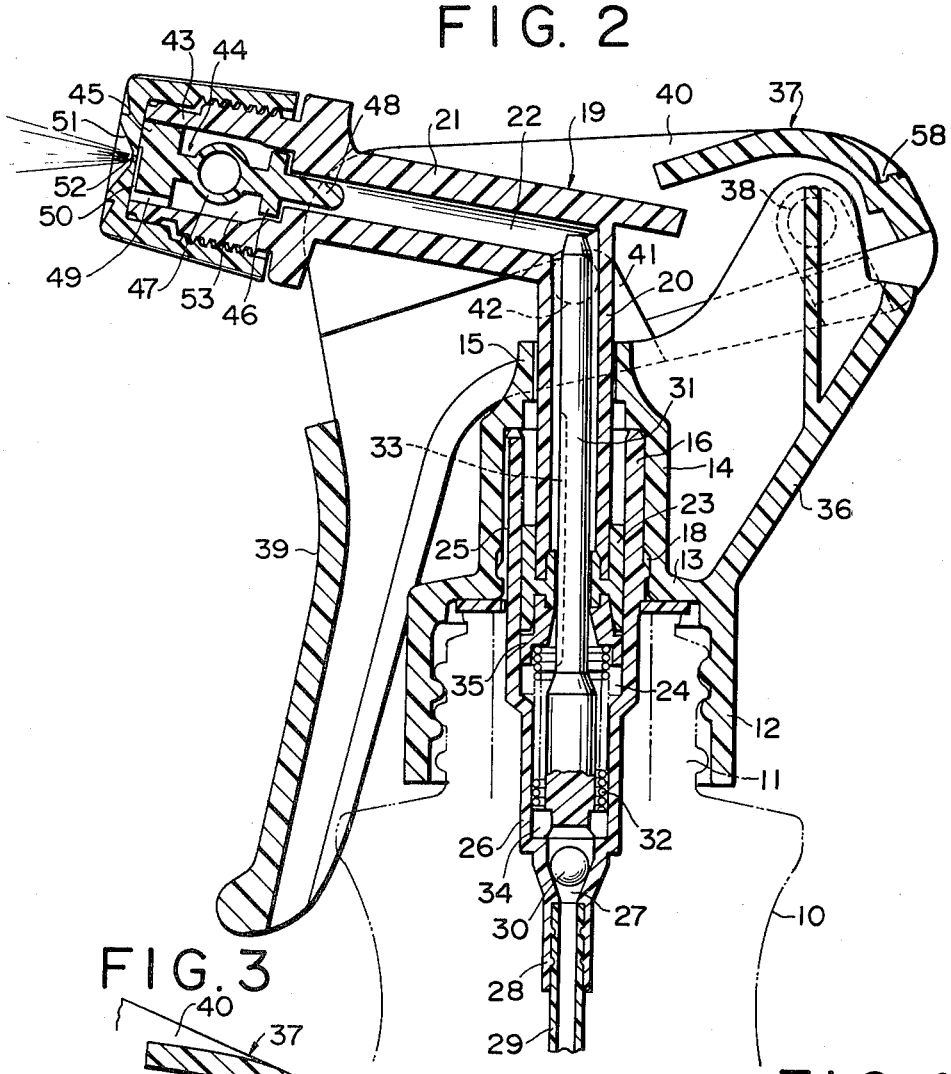
FIG. 2 is a longitudinal section showing the actuated state of the device of FIG. 1 in which the trigger means is pulled fully to the ultimate position thereof.

When the state shown in FIG. 2 has been attained, wherein the vertical pipe portion 20 has been lowered to the lower limit thereof, the pressurization of the pump chamber 24 is terminated and, therefore, the fluid pressure urging the valve body 46 of the discharge valve 44 toward the cavity 53 is reduced and the valve body 46 is pushed back, by means of the elasticity of the ring member 47, toward the right, as seen in FIG. 2, thereby closing the valve seat portion of the fluid passage so as to terminate the spraying action. Then, if the forefinger is disengaged from the trigger means 39, the vertical pipe portion 20 is lifted vertically upwardly by the biasing force of the spring 39. At this time, a negative pressure is produced in the pump chamber 24 and, therefore, the ball valve 30 is opened so as to permit additional liquid to be sucked up into the pump chamber. In the meantime, the lifting of the vertical pipe portion 20 causes the crank lever 37 to be rotated, through means of the cooperative action of the guide groove 41 and pin 42 so as to return the device to the initial condition thereof whereby the same is ready for a subsequent spraying operation.

It is preferred that most parts of the device according to the invention described hereinbefore be fabricated of a plastic material such as polypropylene, polyethylene, nylon, or the like. The device according to the present invention is characterized in that the injection pipe member 19 is vertically lifted and lowered along the axis of the vertical pipe portion 20. Furthermore, according to the present invention, since the pump action is obtained by vertically reciprocating the vertical pipe portion 20 in the cylinder member 16 provided in the cylinder 14, the suction of the liquid can be significantly facilitated with a relatively small amount of leakage, and even if leakage occurs, the leaked liquid will be entirely returned to the container without staining the environs of the cap portion.

Still further, according to the present invention, since a system is adopted in which the injection pipe member 19 is vertically reciprocated so as to dispense the pressurized liquid by means of operating the crank lever 37 pivotally attached to the bracket 36, the entire device can be fabricated in a compact form and the handling thereof can be facilitated. In addition, the arcuately curved form of the trigger means 39, and the joint of the yoke portion 40 to the bracket 36 through means of the use of pin 42, ensure a positive operation of the device. Likewise, the direct insertion of the injection pipe member 20 into the pump chamber 24 for producing the pressurized state can render the construction of the device quite simple as compared with conventional trigger type sprayers.

Still yet further, according to the present invention, since the guide groove 41 is provided on the inside of the yoke and the pin 42 of said injection pipe member is engaged in said guide groove, the vertical pipe portion 20 can be vertically reciprocated in an accurate and smooth manner in accordance with the movement of the crank lever 37. In addition, since the sealing means 23 attached to the lower end of the vertical pipe portion 20 is made of an elastic rubber material, the fitting and the replacement thereof can be facilitated and dual sealing functions can be provided in that the sealing means is in contact with the internal wall surface of the cylinder member 16 so as to completely prevent the leakage from the piston portion of the device during the course of the pump operation and, when the vertical pipe portion 20 is in the upper limit position thereof, the sealing means is contact with the inner shoulder portion of the cylinder 15 so as to close the gap communicating with the concave groove 25 for the air introduction, thereby also preventing leakage of the liquid. If the sealing means also has the function as a spring bearing, then said spring bearing seat 35 may be omitted.

As described previously, in the device according to the present invention, when the liquid is fed into cavity 53 under pressure from the fluid passage 22 of the injection pipe member, the valve body 46 is pushed into the cavity 53 by the pressure overcoming the elasticity of the ring member 47 so as to open the valve hole. The pressurized liquid thus entering the cavity is permitted to be sprayed out conically in a finely atomized state from the axial nozzle aperture or orifice 52 after passing through the slots 49 and the slots 50 formed in the base plate 45. When the feeding of the liquid under pressure is terminated, the pressure exerted on the valve body 46 is decreased and, therefore, the valve hole can be closed automatically by the action of the elasticity of the ring member 47. Alternatively, slots may be formed in the inner wall of the cavity by smoothly finishing the peripheral wall of the base plate 45. Furthermore, according to the present invention, the valve body 46 of the dischage valve can be in contact with the valve seat under pressure by merely fitting the discharge valve into the cavity 53 whereby the ring member 47 constituting an elastic means may be interposed between the base plate 45 and the valve body 46 in a compressible state so as to ensure a positive urging biasing effect on the valve body 46. Still further, since the base plate, ring member and the valve body are integrally formed, these parts will not be separated and, therefore, none of them will be lost in disassembling and assembling the device.

Although I have shown and described the preferred embodiment of present invention, it will be understood by those skilled in the art that some changes and modification may be made in the details thereof without departing from the spirit and scope of the present invention.

What I claim is:

1. A trigger type spraying device, for spraying a liquid by using pump pressure, comprising:

a body portion including a cap, for threaded engagement with the neck portion of a container housing a liquid to be sprayed, and a cylindrical portion;

a cylinder member, having a pump chamber defined therein, attached to said cylindrical portion;

a bracket integrally formed with said first cylinder at one side thereof;

a crank lever pivotally mounted upon said bracket, and including an arcuately curved trigger portion and a yoke portion coupled to said trigger portion;

an injection pipe member, including a vertical pipe portion and an oblique pipe portion having a common fluid passage defined therein, disposed interiorly of said yoke;

a pin, projecting laterally from said injection pipe member, engaged in a guide groove formed upon the inside of said yoke portion and serving as a cam means for operative cooperation with said pin;

said vertical pipe portion being slidably disposed within said cylindrical portion and said cylinder member between a first, raised position, and a second, lowered position;

sealing means mounted upon said vertical pipe portion for sealing both said cylindrical portion and said cylinder member when said vertical pipe portion is in said first and second positions, respectively;

spring biasing means disposed within said pump chamber for biasing said vertical pipe portion toward said first position;

said sealing means including an inner cylindrical portion and an outer cylindrical portion, said inner and outer portions being coupled together by means of an annular member interposed therebetween so as to define upper and lower annular spaces within which the lower end of said vertical pipe portion, and the upper end of said spring biasing means, are respectively disposed;

suction valve means disposed within said pump chamber for controlling the fluid flow therein;

discharge valve means disposed within the tip of said oblique pipe portion; and nozzle means mounted upon said tip of said oblique pipe portion.

2. A spraying device according to claim 1, wherein said discharge valve comprises an elastically deformable ring member interposed between, and formed integrally with, a disc-type base plate and a valve body.

3. A spraying device according to claim 1, wherein said discharge valve means comprises:

an elastic ring member, a base plate having slots, provided on the side opposite that disposed toward said ring member, extending in the radial direction thereof, and a valve body having a guide projection, on the side opposite that disposed toward said ring member, extending in the axial direction thereof, said base plate and said valve body being integrally formed with said ring member.

4. A spraying device according to claim 1, wherein:

said pin, engaging said guide groove, is disposed externally of the bent portion of said injection pipe member defined between said vertical pipe portion and said oblique portion.

* * * * *